United States Patent [19]

Migirian

[11] 4,026,185

[45] May 31, 1977

[54] DRUM

[76] Inventor: George Migirian, 2832 E. Grand Blvd., Detroit, Mich. 48211

[22] Filed: Oct. 21, 1975

[21] Appl. No.: 624,429

[52] U.S. Cl. ..... 84/411 R
[51] Int. Cl.[2] ..... G10D 13/02
[58] Field of Search ..... 84/411–420; D56/1 E

[56] References Cited

UNITED STATES PATENTS

| | | | |
|---|---|---|---|
| 2,132,211 | 10/1938 | Hueckstead | 84/422 |
| 3,621,749 | 11/1971 | Aluisi | 84/411 |
| 3,724,313 | 4/1973 | Frigo | 84/411 X |
| 3,818,791 | 6/1974 | Zickos | 84/411 |
| D100,734 | 8/1936 | Lira | D56/1 E |
| D185,097 | 5/1959 | Piskos | D56/1 E |

*Primary Examiner*—Lawrence R. Franklin
*Attorney, Agent, or Firm*—Harness, Dickey & Pierce

[57] ABSTRACT

A drum is formed from a casing of wood, metal, plastic or the like which is of rectangular or other polygonal shape, which shape forms the wall of the drum. The ends of the casing are open, the one end having a circular or oval shaped frame extending therefrom over which a sheet of vellum is supported and stretched to form a percussion head. The opposite end of the casing is enclosed by spaced louvers which may be fixed in position or pivotedly supported for angular positioning within a frame. A baffle is provided within the casing which is operated to different angular positions from the bottom by a lever which extends through the casing at one side thereof.

7 Claims, 5 Drawing Figures

FIG. 1.
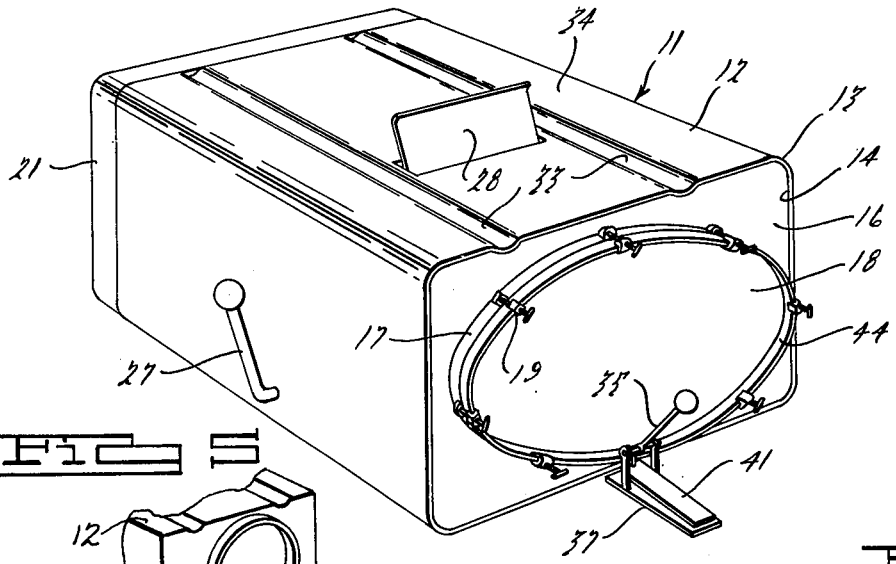
FIG. 5
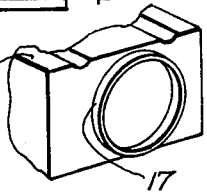
FIG. 4.
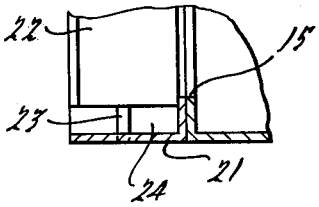
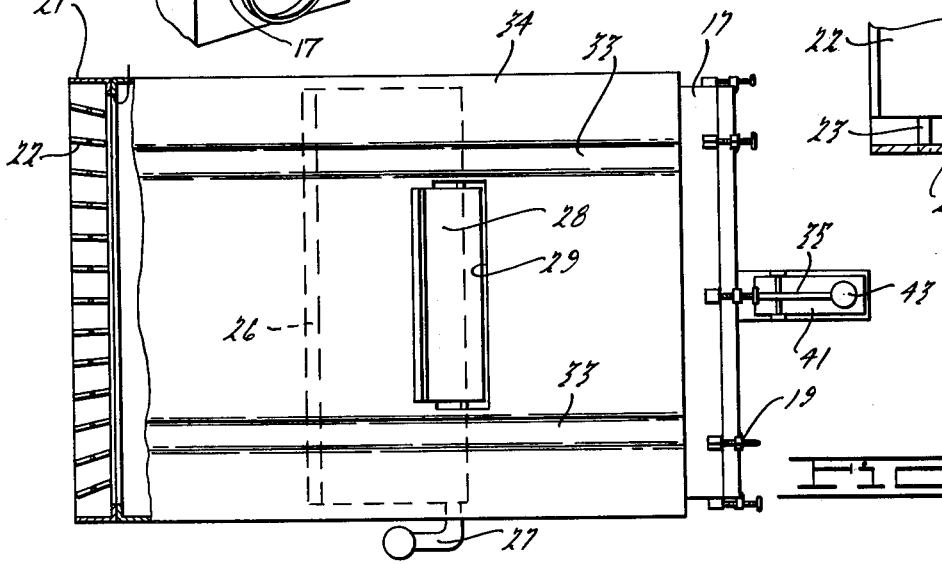
FIG. 2.
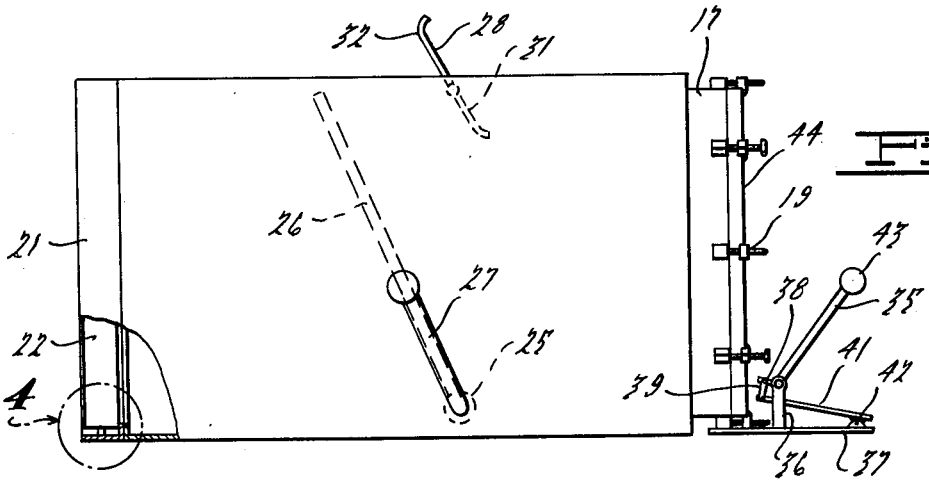
FIG. 3.

DRUM

BACKGROUND OF THE INVENTION

The drums ordinarily in use have a casing which is cylindrical in form with a flange at each end over which a sheet of vellum is stretched. A large drum like the one of the present invention is of the bass type. The ones of smaller diameter are known as snare drum and tom-tom. A search uncovered the following U.S. patents which indicate the state of the art at the present time.

No. D100,734; No. D210,321: No. 3,603,194 No. 3,680,423.

SUMMARY OF THE INVENTION

The invention pertains to a bass drum having a casing which is of rectangular form with both ends open. A circular, oval or other shaped frame supported at one opening has a vellum sheet supported thereon and stretched taut to form a percussion head which is struck by a drum stick to produce a beat. The opposite end is enclosed by fixed or movable louvers to direct the emission of the sound, a baffle within and near the bottom of the casng which is movable to different angular positions by an arm that extends through one side of the casng controls the volume of emission. A pivoted deflector panel is mounted in a slot in the top of the casing with the lower part of the panel extending therewithin and the upper part thereof extending thereabove for deflecting the sound within the casing outwardly thereof toward the end having the percussion head. A drum stick is mounted on a pivotal support for striking the head when a foot treadle is used for operating the drum stick.

BRIEF DESCRIPTION OF THE DRAWING

FIG. 1 is a perspective view of a drum which embodies features of the present invention;

FIG. 2 is a plan view of the drum illustrated in FIG. 1;

FIG. 3 is a side view of the drum illustrated in FIG. 1, with a part broken away and FIG. 4 is an enlarged view of the structure illustrated in FIG. 3, taken within the circle 4 thereof.

FIG. 5 is a view of structure similar to that illustrated in FIG. 1, showing another form of head.

DESCRIPTION OF THE PREFERRED EMBODIMENT

The drum 11 has a casing 12 which is rectangular in form with arcuate corners 13 and open ends 14 and 15. An end wall 16 having an oval shaped hollow frame 17 closes the open end 14 with the longest side of the casing forming the top and bottom portions thereof. A vellum sheet 18 borning a drum head diaphragm is placed over the frame which is drawn taut thereover by the screw operating elements 19. The open end 15 of the casing is enclosed by a frame 21 having a plurality of vertically disposed louvers 22 which extend from the top to the bottom of the frame. As illustrated in FIG. 4, the louvers 22 may be secured by pivots 23 in apertured members 24 which are mounted at the bottom and top of the frame 21. The louvers direct the sound as it is emitted from the end of the casing having the opening 15 thereat.

A shaft 25 extends across the casing near the bottom for supporting a baffle 26 therewithin to be swung to different angular positions with the shaft 25 when operated by an arm 27 on the outside of the casing. A panel 28 extends through a slot 29 in the top wall 30 of the casing 12 having a lower portion 31 extending within the casing and an upper portion 32 extending upwardly thereabove. The panel deflects the sound produced within the casing toward the musician forwardly of the percussion head so that he can analyze the sound which is being produced thereby. A pair of depressed channels 33 are provided in the top wall 30 of the casing for supporting drum sticks or other elements which may otherwise roll therefrom.

A drum stick 35 is mounted on a pair of spaced upright elements 36 which are secured to a base element 37. A forwardly extending arm 38 on the drum stick 35 is connected by a link 39 to the forward end of a foot treadle 41 which is secured by a rear pivot 42 to the base element 37. By moving the treadle 41 downwardly, the striking end 43 of the drum stick 35 moves forward and strikes the percussion head 44 which was constructed by stretching a sheet of vellum across the frame 17. This is believed to be a new concept for bass drums as only one percussion head is provided and that on a rectangular casing which is of substantial length having vertically extending louvers mounted on the opposite end from that forming the percussion head.

A baffle within the casing 12 controls the emitted sound which may be spread by the louvers when in fixed position or when pivotally mounted within the frame 21. The panel 28 may be tilted to different positions to have the sound produced within the casing 12 from the percussion head deflect forwardly toward the drum operator so that the sound can be better analyzed. Control is provided for the developed sound when positioning the loeuvers 22 and adjusting the baffle 26 as the sound is being produced by the drum stick 35 and analyzed by the reflection of the sound from the panel 28. The frame 17 is illustrated in FIG. 1 as extending outwardly from the edge of an oval shaped opening 20 and in FIG. 5 as extending outwardly from an opening of circular shape. The sound waves produced thereat are permitted to expand laterally within the rectangular casing 12 changing the tonal effect thereof.

What is claimed is:

1. In a drum, a hollow casing of rectangular section having both ends open, a rectangular panel for closing one end of said casing, said panel having an opening, a frame about said opening extending outwardly therefrom, a drum head diaphragm stretched over said frame to cover said frame opening, means for drawing said diaphragm taut relative to said frame to form a percussion head, and spaced louvers mounted across the opposite end of said casing from that forming the percussion head.

2. In a drum as recited in claim 1, wherein the said rectangular casing has sides, top and bottom sections which are joined at the corners therebetween by arcuate portions providing rounded corners.

3. In a drum as recited in claim 1, wherein said louvers are pivotedly mounted to be adjustable to different positions across said end.

4. In a drum as recited in claim 1, wherein the frame on the rectangular panel is oval shaped.

5. In a drum as recited in claim 1, wherein said frame on the rectangular panel is of circular shape.

6. In a drum as recited in claim 5, wherein a pivotal shaft is provided near the inner bottom side of the rectangular casing having a lever extending therefrom to the outside, a rectangular baffle on said shaft which is adjusted to different angular positions within the casing providing a variable rectangular opening at the top when the baffle is shifted.

7. In a drum as recited in claim 1, wherein said casing has a top, a bottom and two sides, a sound deflector panel pivoted in an opening in the top of the casing with the bottom portion extending therewithin and with the top portion extending thereabove for deflecting the developed inner sound exterior of the casing toward the percussion end of the drum.

* * * * *